United States Patent [19]

Landes et al.

[11] 4,011,724

[45] Mar. 15, 1977

[54] DUAL FORCE ACTUATOR

[75] Inventors: Ralph K. Landes, Atlanta; William E. Thomas, Marietta, both of Ga.

[73] Assignee: Lockheed Aircraft Corporation, Burbank, Calif.

[22] Filed: Sept. 16, 1971

[21] Appl. No.: 181,176

[52] U.S. Cl. ..... 60/567

[51] Int. Cl.[2] ..... F15B 3/00

[58] Field of Search ..... 60/54.6 HA, 54.5 HA, 60/54.6 H, 54.5 H, 567; 92/65

[56] References Cited

UNITED STATES PATENTS

| | | | |
|---|---|---|---|
| 2,032,185 | 2/1936 | Sciaky | 60/567 X |
| 2,169,423 | 8/1939 | Kessler et al. | 60/54.5 HA |
| 2,656,745 | 10/1953 | Forichon | 60/54.5 HA |
| 3,253,412 | 5/1966 | Torossian | 60/54.5 HA |
| 3,426,530 | 2/1969 | Georgelin | 60/54.5 HA |
| 3,499,369 | 3/1970 | Joseph | 92/65 |

FOREIGN PATENTS OR APPLICATIONS

| | | | |
|---|---|---|---|
| 178,613 | 3/1962 | Sweden | 60/54.5 HA |

*Primary Examiner*—Martin P. Schwadron
*Attorney, Agent, or Firm*—Billy G. Corber; A. L. Carter

[57] ABSTRACT

Actuator for selectively and sequentially providing dual pressure forces for positioning and seating fasteners and for other purposes. Air pressure is selectively applied to a first piston to apply a relatively low level of hydraulic pressure to the actuating rod and then to a second pneumatic piston to intensify the hydraulic pressure applied to the actuating rod. The actuator is caused to be extended a first distance at low force and then to be extended an additional distance at a relatively higher force. Air pressure is selectively applied to cause all pistons and the actuating rod to retract to their initial positions.

5 Claims, 3 Drawing Figures

FIG. 1
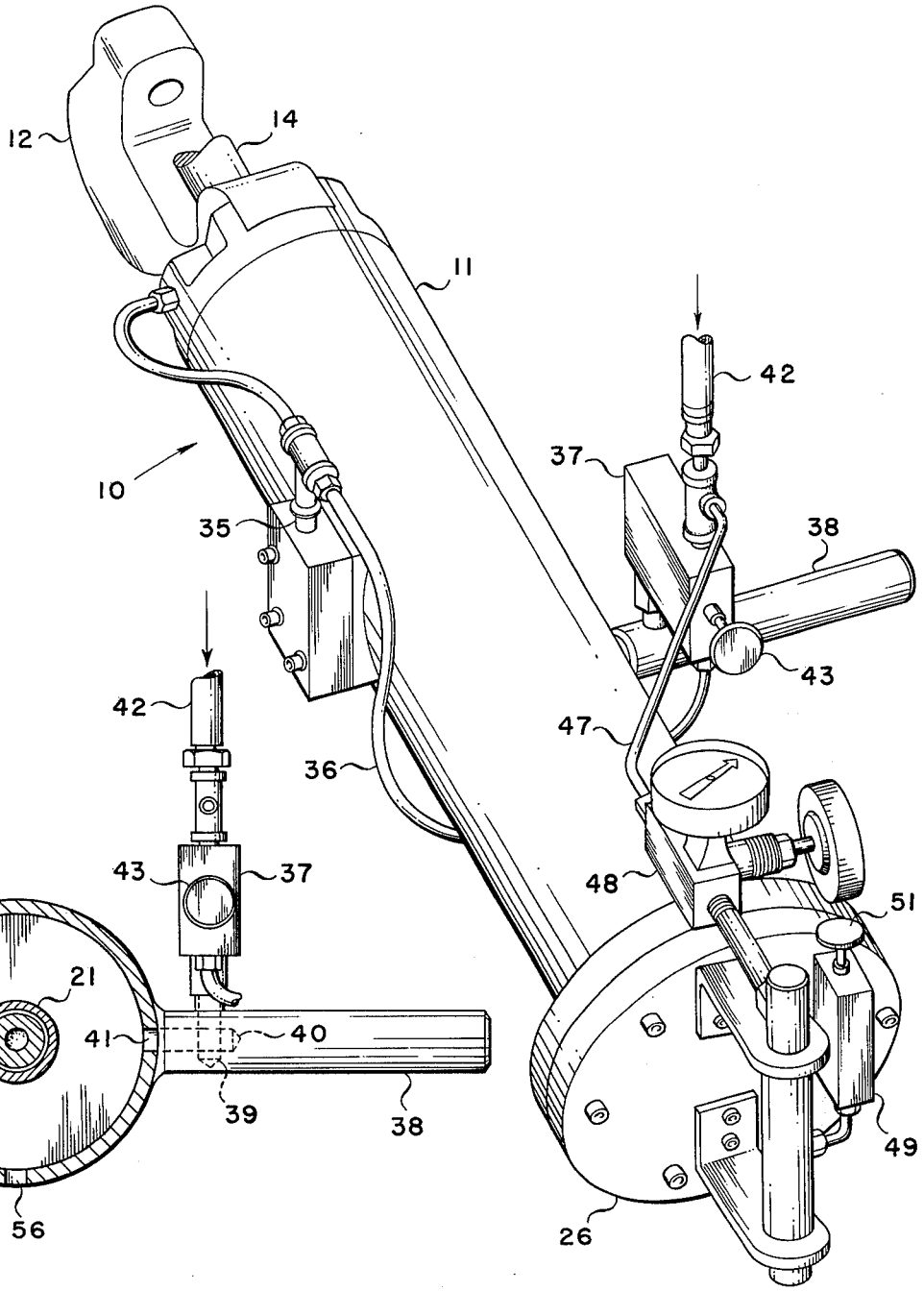
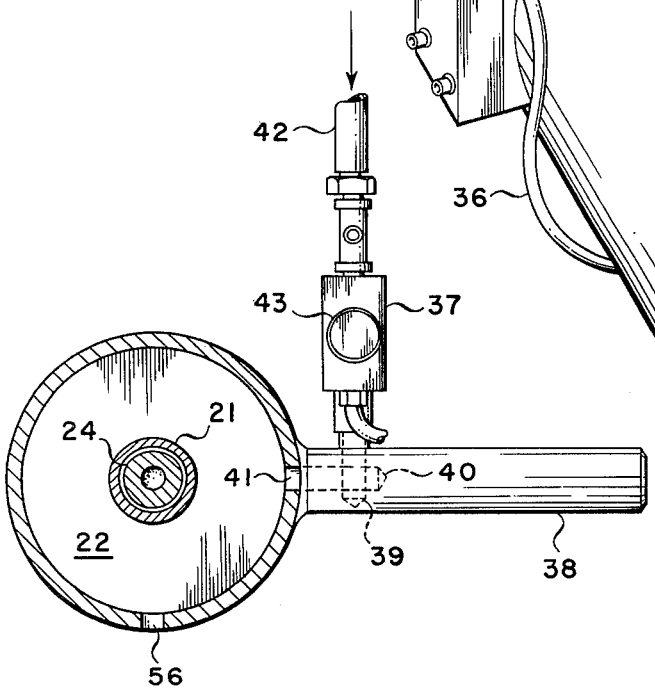
FIG. 3
RALPH K. LANDES
WILLIAM E. THOMAS
*INVENTORS.*
*BY* George C. Sullivan
Agent

RALPH K. LANDES
WILLIAM E. THOMAS
*INVENTOR.*

BY George R. Quellmann
Agent

DUAL FORCE ACTUATOR

This invention relates in general to an actuating apparatus, and more particularly to an actuator capable of incremently extending an actuating member at different levels of force.

There is frequent need for an actuating apparatus which is capable of applying different levels of force to a workpiece as well as other applications. For example, a particular application may require an actuator that can be extended a first distance at a relatively low level of force so as to define an initial location or position of the actuator or of a workpiece contacted by the actuator, and then to extend the actuator a second distance at a relatively greater force to complete an operation. A specific example of the foregoing is found in the installation of certain types of fasteners as exemplified by the fastener disclosed in U.S. Pat. No. 3,438,418 wherein a relatively low level of force is applied to cause initial location and positioning of the fastener within the fastener hole and then a substantially greater amount of force is applied to cause seating of the fastener.

The problem of providing proper positioning and seating forces for such fasteners installed in a complex structure such as an airframe or the like is magnified when the fasteners are installed during the final assembly operation by the airframe manufacturer or else when the fasteners are to be installed incidental to the maintenance or repair of the structure whereat the inserting and seating forces must be applied by relatively portable or hand-held equipment capable of use in locations which are not readily accessible for use of conventional machine tools and equipment normally used in the manufacturing process.

Accordingly, it is an object of the present invention to provide an improved actuator.

It is another object of this invention to provide an actuator capable of exerting different levels of force.

It is still another object of the present invention to provide an actuator capable of a first amount of actuation at an initial force level and further capable of a second amount of actuation at a different force level.

It is a further object of the present invention to provide a dual force actuator which is relatively portable and is capable of being manually held and positioned for use by an operator.

The exact nature of this invention as well as other objects and advantages thereof will be readily apparent from consideration of the following specification relating to the annexed drawings, in which:

FIG. 1 shows as isometric exterior view of one embodiment of the present invention showing part of the external pneumatic plumbing thereon;

FIG. 3 shows a section view taken along line 3—3 of FIG. 2.

Figure 2:
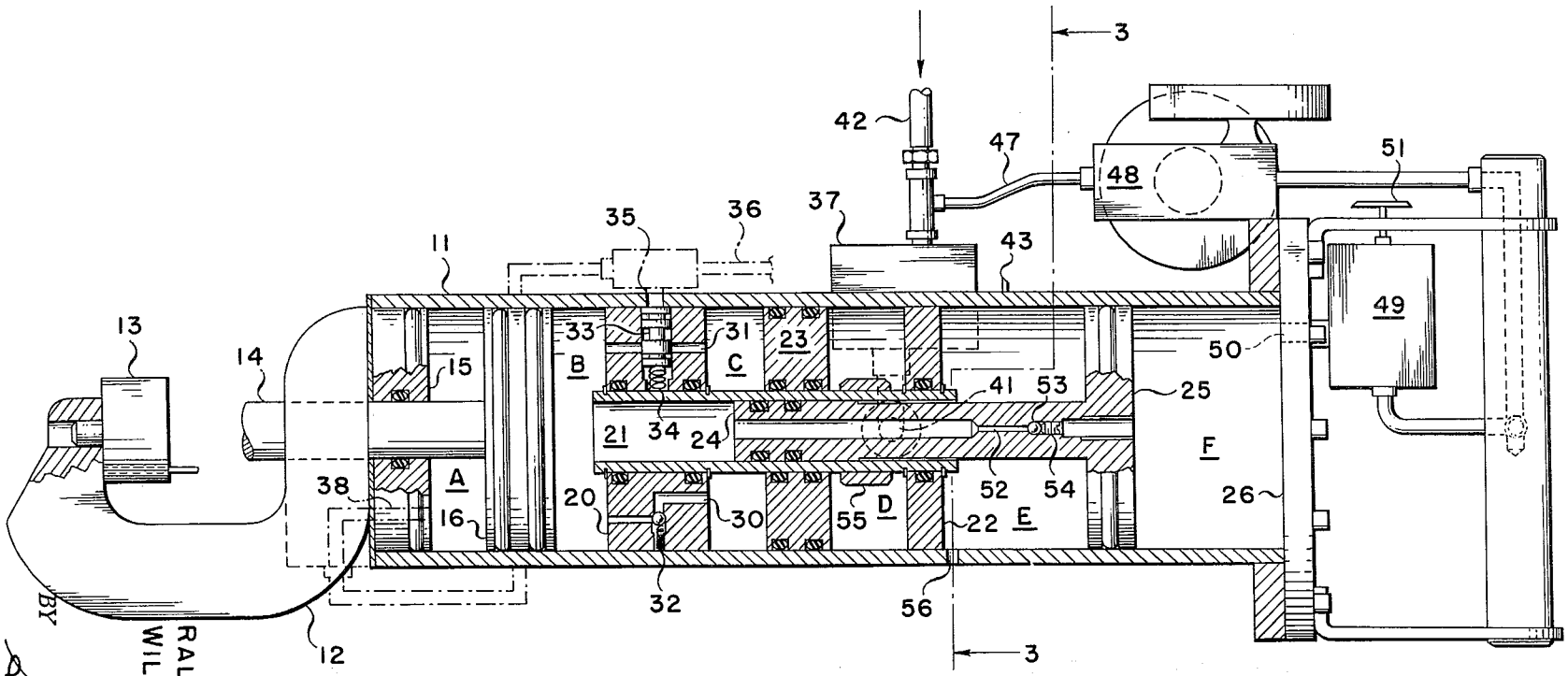
FIG. 2 shows a longitudinal, partial cross-section view of the embodiment of FIG. 1 with some of the external pneumatic plumbing shown in phantom and some of the internal features relocated arcuately for clarification of the operation of this invention.

Stated generally, the disclosed embodiment of the present invention includes an actuating piston which is hydraulically driven to extend a first distance at a first force by an air-powered floating piston. A second air-powered piston operates a hydraulic pressure intensifier which increases the hydraulic pressure applied to the actuating piston. The actuating piston thus is extended an additional distance at an increased level of force.

Stated more particularly and with reference taken to FIGS. 1–3 of the drawings, an embodiment of the present invention is shown generally at 10 and includes a cylinder 11 having a foot 12 and an anvil 13 (shown in FIG. 2) for supporting a workpiece. An actuating member 14 (shown partially broken away) is slidably received in an aperture through the end member 15 and is connected to the actuating piston 16 slidably received within the interior of cylinder 11.

A first partition member 20 is immovably secured to the interior of the cylinder 11. A conduit 21 is affixed to an axial opening in the first partition member 20 and extends along a portion of the length of the cylinder 11 to be fixedly secured to an axial opening in a second partition member 22 that is also immovably secured to the interior of cylinder 11. A floating piston 23 is mounted for sliding movement along the exterior of the conduit 21. An intensifier piston 24 is slidably received within the interior of the conduit 21 and is attached to a piston 25 slidably received within the cylinder 11. O-ring seals are employed at the various sliding surfaces to prevent fluid leakage as is known to those skilled in the art.

For convenience in understanding the construction and operation of the disclosed embodiment, the various chambers of the cylinder 11 can be arbitrarily designated as shown in FIG. 2 with chamber A being defined by the actuating piston 16 and the end member 15, chamber B being defined by the first partition member 20 and the actuating piston 16, chamber C being defined by the floating piston 23 and the first partition member 20, chamber D being defined by the second partition member 22 and the floating piston 23, chamber E being defined by the piston 25 and the second partition member 22, and chamber F being defined by the piston 25 and the end member 26 of the cylinder 11.

The first partition member 20 has a pair of fluid passages 30 and 31 interconnecting chambers B and C. The passage 30 has a one-way valve 32 which permits fluid to pass from chamber C to chamber B and which blocks the flow of fluid in the reverse direction through the passage 30. A shuttle valve 33 associated with the passage 31 is biased by the spring 34 to block fluid flow through the passage 31; however, fluid pressure applied through the opening 35 in the cylinder wall causes the shuttle valve to be depressed against the force of the spring 34 to permit fluid flow through the passage 31.

Fluid pressure is applied to the connection 35 through a fluid line 36 connected to a four-way valve 37. An extension of the fluid lines 36 is connected to a passage 38 through the end member 15 and in communication with the chamber A.

The four-way valve 37 is mounted on the side handle 38 to provide fluid communication to the chamber D by way of passages 39 and 40 and the opening 41 in the wall of the cylinder 11. The four-way valve 37 which receives fluid supply pressure, for example air pressure, through an input line 42 is of the type which supplies fluid pressure to both the passage 39 and the line 36 when the valve actuator 43 is in a first position and which vents both the passage 39 and the line 36 to atmosphere when the valve actuator 43 is moved to a second position.

Fluid pressure also is supplied from the line 42 and a line 47 through an adjustable pressure regulator 48 and suitable conduit to a three-way valve 49 mounted on the end member 26 of the cylinder. The valve 49 is in fluid communication with the chamber F through passage 50 in the end member 26. When the valve actuator 51 of the three-way valve 49 is moved to a first position, air or other fluid at regulated pressure is admitted to the chamber F through the passage 50 and when the valve actuator is moved to a second position, the chamber F becomes vented to atmospheric pressure through the passage 50 and the valve 49.

Chamber E is continually open to the atmosphere through vent 56.

The disclosed embodiment of the present invention uses air pressure supplied through the line 42 to produce both the low force and the high force actuation of the member 14. The chambers B and C and all passages communicating therewith are completely filled with a suitable liquid such as oil or hydraulic fluid for a purpose which will become apparent below. The passageway 52 and the ball seal 53 contained in the intensifier piston 24 facilitate bleeding air from the chambers B and C while those chambers are being filled with liquid during the assembly of the actuator. A threaded plug 54 is inserted to firmly seal the ball 53 once the bleeding process is finished.

In describing the operation of the disclosed embodiment, assume that the pistons 16, 23, and 25 are positioned in the extreme right-hand position as shown in FIG. 2 and that a fastener or other appropriate workpiece is inserted between the anvil 13 and the appropriate tool (not shown) contained on the outer end of the actuating member 14. The operator then moves the valve actuator 43 to a first position which admits air pressure from the valve 37 through the opening 41 to chamber D while maintaining the line 36 vented to the atmosphere. At this time, accordingly, chamber A is vented to the atmosphere through the passage 38 and the line 36 and the shuttle valve 33 is moved by the spring 34 to block the passage 31.

The pressurized air entering the chamber D forces the floating piston 23 leftward as viewed in FIG. 2 to displace the liquid from chamber C through the passage 30 and the one-way valve 32 to enter chamber B and thus to move the actuating piston 16 leftward. This action continues until the floating piston 23 contacts the first partition member 20 at which time the actuating member 14 will have been extended a first amount at a force determined by the air pressure supplied to the chamber D.

If the operator now is ready to cause further movement of the actuating member 14 at an increased force, he moves the valve actuator 51 to a first position which introduces air pressure through the passage 50 to the chamber F, thereby forcing the piston 25 to move to the left. This movement of the piston 25 drives the intensifier piston 24 through the interior of the conduit 21, displacing liquid therefrom and thus causing the actuating piston 16 and the actuating member 14 to move leftward an additional amount under the increased force resulting from the movement of the relatively small diameter intensifier piston 24 as compared with the relatively large diameter air-powered piston 25. The leftward movement of the actuating member 14 stops when the piston 25 contacts the right-hand end of the conduit 21.

Assuming now that the operator wishes to retract the actuating member 14, he moves both valve actuators 43 and 51 to respective second positions. The valve 49 removes air pressure from the chamber F and vents that chamber to the atmosphere while the four-way valve 37 causes the chamber D to be vented to the atmosphere through the opening 41 and also applies air pressure to the line 36. The shuttle valve 33 is moved inwardly against the force of the spring 34 to unblock the passage 31 thus permitting liquid to flow therethrough. Air pressure applied through the passage 38 to chamber A forces the actuating piston 16 to move to the right, such movement displacing the liquid in chamber B through the now-unblocked passage 31 into chamber C and also forcing the intensifier piston 24 and the piston 25 associated therewith to move rightwardly. The return of the liquid to chamber C causes rightward movement of the floating piston 23 to a point where this piston contacts the collar 55 concentrically mounted on the exterior of the conduit 21. Since the floating piston 23 is forced rightwardly by liquid displacement resulting from the retraction of the actuating piston 16, one segment of the maximum rightward or fully retracted position of the actuating member 14 is determined by the width or location of the collar 55, the same as another segment of the extent of retraction involves the amount of travel of intensifier piston 24 permitted rightwardly through conduit 21. It will be obvious to those skilled in the art that additional collars for the similar purpose of limiting the extent of piston movements could be provided, for example, around the conduit 21 between the floating piston 23 and the partition member 20 and/or between the piston 25 and the second partition member 22, so as to limit the amount by which the actuating member 14 moves in extension during either or both of the low-force and high-force modes, as well as control or limit the amount of retraction.

While the described embodiment of the present invention is shown as a fastener installing apparatus, it will be apparent that the dual-force actuator of the present invention can readily be configured as a fluid-powered actuator of general utility wherever the requirement exists for such an actuator having dual-stroke length and/or dual levels of actuating force.

It should be understood, of course, that the foregoing relates to only a preferred embodiment of the invention and that numerous modifications or alterations may be made therein without departing from the spirit and scope of the invention as set forth in the appended claims.

What is claimed is:

1. Apparatus for operating an actuator member at plural levels of force comprising:

a cylinder means having a hollow bore therein;

an actuating piston means reciprocally contained within said bore and having first and second sides;

an actuating means operably connected to said cylinder means;

a first pressure controlled means contained within said cylinder means and operative to produce and apply fluid pressure to said first side of said actuating piston means at a first level of pressure, said first pressure controlled means including a first pressure producing piston slidably contained within said cylinder means and slidably movable to selectively exert said first level of fluid pressure on said first side of said actuating piston means;

a second pressure controlled means contained within said cylinder means and operative to produce and apply fluid pressure to said first side of said actuating piston means at a second level of pressure higher than said first level of pressure, said second pressure controlled means including a second pressure producing piston contained within said cylinder in axial alignment with said first pressure producing piston and slidably movable to selectively exert said second level of fluid pressure on said first side of said actuating piston means, said second level of pressure produced by said second pressure controlled means adapted to become operative on said actuating piston means without releasing said first level of pressure produced by said first pressure controlled means whereby said first level of pressure becomes amplified and once established is continuous until amplified;

pressure release means for removing fluid pressure from said first side of said actuating piston means;

means for exerting a fluid pressure on the second side of said actuating piston means to return said actuating piston means to a retracted position upon release of fluid pressure on said first side of said actuating piston means;

a first partition means fixedly disposed within said cylinder means to separate said actuating piston means and said first pressure producing piston;

a first fluid passage means contained in said first partition means to establish communication between the first pressure piston side and the actuating piston means said of said first partition means; and one-way valve means contained in said first passage means to permit fluid to flow only from said first pressure piston side of said first partition means to said actuating piston means side thereof.

2. Apparatus as in claim 1, further comprising:

a second partition means fixedly disposed within said cylinder means wherein said first pressure producing piston is located intermediate said first and second partition means. and said second partition means is located intermediate said first and second pressure producing pistons;

an imperforate conduit extending through said second partition means, said first pressure producing piston, and said first partition means with said conduit fixedly connected to said first and second partition means;

said second pressure producing piston including an axial extension of reduced diameter relative to said piston diameter and slidably located within said conduit.

3. The apparatus of claim 2 including a hydraulic fluid medium contained within the compartments defined by the first partition means and the actuating piston, the first partition means and the first pressure producing piston, and the conduit portion unoccupied by the axial extension of said first pressure producing piston, whereby said fluid pressure on said actuating piston is a hydraulic pressure.

4. Apparatus as in claim 3 wherein:

said first and second pressure controlled means each include a means for application and control of a pneumatic fluid pressure to said first and second pressure producing pistons for application in turn of a hydraulic pressure to said actuating piston means.

5. Apparatus as in claim 1, wherein said release means removing fluid pressure from said first side of said actuating piston includes a second fluid passage means contained in said first partition means communicating between the first pressure piston side and the actuating piston side of said first partition means; and a flow control means in said second fluid passage means to permit fluid flow from said actuating piston side of said first partition means to said first pressure piston side thereof.

* * * * *